US006268113B1

(12) United States Patent
DeBoer et al.

(10) Patent No.: US 6,268,113 B1
(45) Date of Patent: Jul. 31, 2001

(54) ANTIREFLECTION DIRECT WRITE LITHOGRAPHIC PRINTING PLATES

(75) Inventors: Charles D. DeBoer, Palmyra; Robert G. Spahn, Webster, both of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/070,295

(22) Filed: Apr. 30, 1998

(51) Int. Cl.[7] ..... B41M 1/055

(52) U.S. Cl. ..... 430/302; 430/200; 430/201; 430/945; 101/467; 101/463.1

(58) Field of Search ..... 430/200, 201, 430/945, 302; 101/467, 463.1

(56) References Cited

U.S. PATENT DOCUMENTS

| | | | | |
|---|---|---|---|---|
| 2,244,325 | | 6/1941 | Bird | 516/83 |
| 2,432,484 | * | 12/1947 | Moulton . | |
| 2,574,902 | | 11/1951 | Bechtold et al. | 516/81 |
| 2,597,872 | | 5/1952 | Iler | 106/217.3 |
| 3,665,483 | * | 5/1972 | Becker et al. | 346/135 |
| 3,832,948 | | 9/1974 | Barker | 101/453 |
| 3,964,389 | | 6/1976 | Peterson | 101/467 |
| 4,034,183 | | 7/1977 | Uhlig | 219/121.85 |
| 4,054,094 | | 10/1977 | Caddell et al. | 430/945 |
| 4,081,572 | | 3/1978 | Pacansky | 101/467 |
| 4,731,317 | | 3/1988 | Fromson et al. | 430/945 |
| 5,244,770 | * | 9/1993 | DeBoer et al. | 430/200 |
| 5,256,506 | * | 10/1993 | Ellis et al. | 430/201 |
| 5,372,907 | | 12/1994 | Haley et al. | 430/302 |
| 5,460,918 | | 10/1995 | Ali et al. | 430/200 |
| 5,574,493 | | 11/1996 | Sanger et al. | 347/262 |
| 5,783,360 | * | 7/1998 | Phillips et al. | 430/945 |
| 5,948,481 | * | 9/1999 | Yan et al. | 428/448 |
| 6,090,524 | * | 7/2000 | DeBoer et al. | 430/200 |

FOREIGN PATENT DOCUMENTS

| | | | |
|---|---|---|---|
| 562952A1 | | 3/1993 | (EP) . |
| 55/105560 | | 8/1980 | (JP) . |
| 92/09934 | | 6/1992 | (WO) . |
| WO94/18005 | * | 8/1994 | (WO) . |

* cited by examiner

*Primary Examiner*—Martin Angebranndt
(74) *Attorney, Agent, or Firm*—Raymond L. Owens

(57) ABSTRACT

A direct write lithographic printing plate includes a base layer; a metal light absorbing layer provided over the base layer; and a melanophobic layer provided over the metal absorbing layer and selected to have a thickness which minimizes reflection of light from the metal layer so that light which passes through a selected portion of the melanophobic layer and into the metal light absorbing layer, is absorbed by such metal layer to provide a heat source which causes the removal, at the selected portion, of the melanophobic layer.

4 Claims, 1 Drawing Sheet

ANTIREFLECTION DIRECT WRITE LITHOGRAPHIC PRINTING PLATES

CROSS REFERENCE TO RELATED APPLICATIONS

Reference is made to commonly assigned U.S. patent application Ser. No. 08/979,916 filed Mar. 13, 1997 aband. entitled "Lithographic Printing Plates With a Sol-Gel Layer"; Ser. No. 08/949,699 filed Oct. 14, 1997) aband. entitled "Improved Lithographic Printing Plates Comprising a Photothermal Conversion Material"; Ser. No. 08/949,559 filed Oct. 14, 1997 aband. entitled "Dimensionally Stable Lithographic Printing Plates With a Sol-Gel Layer"; Ser. No. 08/816,287 filed Mar. 13, 1997 aband. entitled "Method of Imaging Lithographic Printing Plates With High Intensity Laser"; and Ser. No. 08/881,163 filed Jun. 24, 1997 aband. entitled "Direct Write Lithographic Printing Plates" to DeBoer and Fleissig, assigned to the assignee of the present invention. The disclosure of these related applications is incorporated herein by reference.

FIELD OF THE INVENTION

The present invention relates to lithographic printing plates which do not require wet processing.

BACKGROUND OF THE INVENTION

The art of lithographic printing is based upon the immiscibility of oil and water, wherein the oily material or ink is preferentially retained by the image area. When a suitably prepared surface is moistened with water and an ink is then applied, the background or non-image area retains the water and repels the ink while the image area accepts the ink and repels the water. The ink on the image area is then transferred to the surface of a material upon which the image is to be reproduced; such as paper, cloth and the like. Commonly the ink is transferred to an intermediate material called the blanket which in turn transfers the ink to the surface of the material upon which the image is to be reproduced.

A very widely used type of lithographic printing plate has a light-sensitive coating applied to an aluminum base. The coating may respond to light by having the portion which is exposed become soluble so that it is removed in the developing process. Such a plate is referred to as positive-working. Conversely, when that portion of the coating which is exposed becomes hardened, the plate is referred to as negative-working. In both instances the image area remaining is ink-receptive or oleophilic and the non-image area or background is water-receptive or hydrophilic. The differentiation between image and non-image areas is made in the exposure process where a film is applied to the plate with a vacuum to insure good contact. The plate is then exposed to a light source, a portion of which is composed of UV radiation. In the instance where a positive plate is used, the area on the film that corresponds to the image on the plate is opaque so that no light will strike the plate, whereas the area on the film that corresponds to the non-image area is clear and permits the transmission of light to the coating which then becomes more soluble and is removed. In the case of a negative plate the converse is true. The area on the film corresponding to the image area is clear while the non-image area is opaque. The coating under the clear area of film is hardened by the action of light while the area not struck by light is removed. The light-hardened surface of a negative plate is therefore oleophilic and will accept ink while the non-image area which has had the coating removed through the action of a developer is desensitized and is therefore hydrophilic.

Direct write photothermal litho plates are known as the Kodak Direct Image Thermal Printing Plate. However, they require wet processing in alkaline solutions. It would be desirable to have a direct write photothermal litho plate that did not require any processing.

The prior art has tried to produce such plates by a variety of means. All of them fall short of a plate that has high writing sensitivity, high image quality, short roll up, and long run length without any processing.

U.S. Pat. No. 5,372,907 describes a direct write litho plate which is exposed to a laser beam, then heated to crosslink and thereby prevent the development of the exposed areas and to simultaneously render the unexposed areas more developable. The plate is then developed in conventional alkaline plate developer solution. The problem with this is that developer solutions and the equipment that contains them require maintenance, cleaning, and periodic developer replenishment, all of which are costly and cumbersome.

U.S. Pat. No. 4,034,183 describes a direct write litho plate without development whereby a laser absorbing hydrophilic top layer coated on a base is exposed to a laser beam to burn the absorber to convert it from an ink repelling to an ink receiving state. All of the examples and teachings require a high power laser, and the run lengths of the resulting litho plates are limited.

U.S. Pat. No. 3,832,948 describes both a printing plate with a hydrophilic layer that may be ablated by strong light from a hydrophobic base and also a printing plate with a hydrophobic layer that may be ablated from a hydrophilic base. However, no examples are given.

U.S. Pat. No. 3,964,389 describes a no process printing plate made by laser transfer of material from a carrier film (donor) to a lithographic surface. The problem of this method is that small particles of dust trapped between the two layers may cause image degradation. Also, two sheets to prepare is more expensive.

U.S. Pat. No. 4,054,094 describes a process for making a litho plate by using a laser beam to etch away a thin top coating of polysilicic acid on a polyester base, thereby rendering the exposed areas receptive to ink. No details of run length or print quality are giving, but it is expected that an uncrosslinked polymer such as polysilicic acid will wear off relatively rapidly and give a short run length of acceptable prints.

U.S. Pat. No. 4,081,572 describes a method for preparing a printing master on a substrate by coating the substrate with a hydrophilic polyamic acid and then imagewise converting the polyamic acid to melanophilic, polyimide with heat from a flash lamp or a laser. No details of run length, image quality or ink/water balance are given.

U.S. Pat. No. 4,731,317 describes a method for making a litho plate by coating a polymeric diazo resin on a grained anodized aluminum litho base, exposing the image areas with a yttrium aluminum garnet (YAG) laser, and then processing the plate with a graphic arts lacquer. The lacquering step is inconvenient and expensive.

Japanese Kokai No. 55/105560 describes a method of preparation of a litho plate by laser beam removal of a hydrophilic layer coated on a melanophilic base, in which a hydrophilic layer contains colloidal silica, colloidal alumina, a carboxylic acid, or a salt of a carboxylic acid. The only examples given use colloidal alumina alone, or zinc acetate alone, with no crosslinkers or addenda. No details are given for the ink/water balance or limiting run length.

WO 92/09934 describes and broadly claim any photosensitive composition containing a photoacid generator and a polymer with acid labile tetrahydropyranyl groups. This would include a hydrophobic/hydrophilic switching lithographic plate composition. However, such a polymeric switch is known to give weak discrimination between ink and water in the printing process.

EP 0 562 952 A1 describes a printing plate having a polymeric azide coated on a lithographic base and removal of the polymeric azide by exposure to a laser beam. No printing press examples are given.

U.S. Pat. No. 5,460,918 describes a thermal transfer process for preparing a litho plate from a donor with an oxazoline polymer to a silicate surface receiver. A two sheet system such as this is subject to image quality problems from dust and the expense of preparing two sheets.

SUMMARY OF THE INVENTION

It is an object of the present invention to be able to prepare a litho plate that has high writing sensitivity, high image quality, short roll up, and long run length without any processing.

This object is achieved by a direct write lithographic printing plate comprising:

a) a base layer;

b) a metal light absorbing layer provided over the base layer; and c) a melanophobic layer provided over th- metal absorbing layer and selected to have a thickness which minimizes reflection of light from the metal layer so that light which passes through a selected portion of the melanophobic layer and into the metal light absorbing layer, is absorbed by such metal layer to provide a heat source which causes the removal, at the selected portion, of the melanophobic layer.

ADVANTAGES OF THE INVENTION

A feature of the present invention is that the melanophobic layer is selected and the thickness of the layer is controlled to reduce the reflection of exposing radiation to a minimum. Exposure of this plate to a high intensity laser beam followed by mounting on a press results in excellent impressions without chemical processing.

An advantage of the invention is that the writing speed of the printing plate is fast because the thermal mass of a metal light absorbing layer is low.

Another advantage of the invention is that the writing efficiency of the printing plate is high because reflections of the writing beam are minimized.

DETAILED DESCRIPTION OF THE INVENTION

Figure 1:
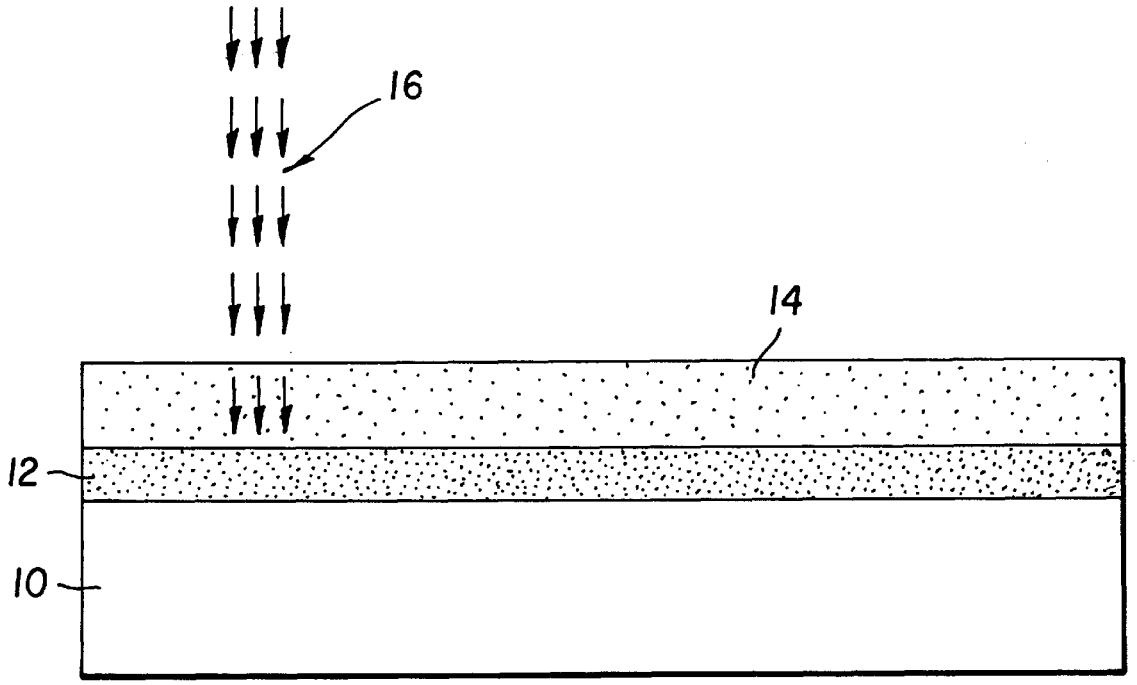
FIG. 1 is a cross sectional view of a lithographic printing plate in accordance with the present invention and prior to exposure by a light source.

FIG. 1 shows a cross sectional view of the printing plate of this invention before exposure, or writing, of the image on the plate. A base 10 is shown, with a metal light absorbing layer 12 over the base and a hydrophilic antireflecting layer 14 over the metal light absorbing layer 12. A laser beam 16 is shown writing a portion of the image area of the image to printed by the printing plate.

Figure 2:
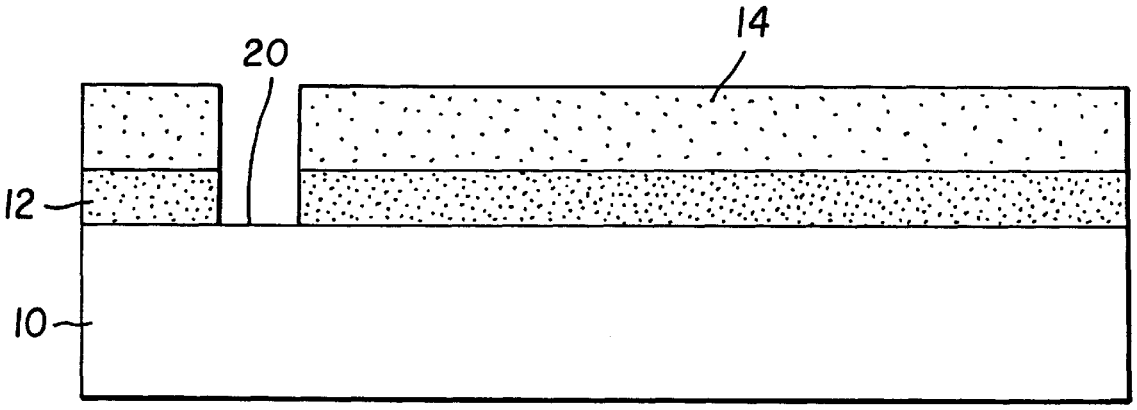
FIG. 2 is a view similar to FIG. 1 but after exposure by a light source to a particular portion of the printing plate.

FIG. 2 shows the same printing plate shown in FIG. 1 after exposure, with the written portion of the image shown as the exposed area 20, where the hydrophilic antireflecting layer 14 and the metal light absorbing layer 12 have been removed by the influence of the laser beam.

The base 10 can be a polymer, metal or paper foil, or a lamination of any of the three. The thickness of the base 10 can be varied, as long as it is sufficient to sustain the wear of the printing press and thin enough to wrap around the printing form. A preferred embodiment uses polyethylene terephthalate in a thickness from 100 to 200 micrometers. Another preferred embodiment uses aluminum from 100 to 500 micrometers in thickness. The base 10 should resist stretching so the color records will register in a full color image. The base 10 may be coated with one or more "subbing" layers to improve adhesion of the final assemblage. The back side of the base 10 may be coated with antistat agents and/or slipping layers or matte layers to improve handling and "feel" of the litho plate.

The terms "melanophilic" and "melanophobic" are Greek for ink-loving and ink repelling, respectively. Since most conventional printing inks are linseed oil based, it will be clear to those skilled in the art that the term "melanophilic" will usually correspond with the terms "oleophilic" and "hydrophobic", while the term "melanophobic" will usually correspond with the term "hydrophilic". As described in the section on the background of the invention, and as is well known to those skilled in the art of lithographic printing, the hydrophilic layer repels ink when it is wet with an aqueous fountain solution.

The metal light absorbing layer 12 absorbs laser radiation and converts it to heat. The metal may be vacuum evaporated or vacuum sputtered. The metal light absorbing layer 12 includes a metallic element of the Periodic Table of the Elements either alone or in combination with another element or alloyed with another elements selected so as to absorb particular wavelengths of light. The thickness of the metal light absorbing layer 12 is such that the optical density of the metal layer is between about 1.0 and 3.0. Higher optical densities may be used, but the more metal that is present in the layer the more energy will be required to expose, or write, the printing plate image. The metal is chosen so the index of refraction and extinction coefficient are such that the hydrophilic layers of the invention will serve as anti-reflection coatings for the selected metal. In general this means that metals with an index of refraction greater than 2 and with an extinction coefficient less than or equal to the index of refraction will serve. In addition, the metal should be easy to coat and adhere well to the base 10 with a suitable coating process.

The melanophobic or hydrophilic antireflecting layer 14 is intended to be wet effectively by the aqueous fountain solution in the lithographic printing process, and when wet, to repel the ink. In addition, it is useful if the hydrophilic layer 14 is somewhat porous, so that wetting is even more effective. The hydrophilic antireflecting layer 14 must be crosslinked if long printing run lengths are to be achieved, because an uncrosslinked layer will wear away too quickly. Many crosslinked hydrophilic layers arc available. Those derived from di, tri, or tetra alkoxy silanes or titanates, zirconates and aluminates ire particularly useful in this invention. Examples are colloids of hydroxysilicon, hydroxyaluminum, hydroxytitanium, and hydroxyzirconium. Those colloids are formed by methods fully described in U.S. Pat. Nos. 2,244,325; 2,574,902; and 2,597,872. Stable dispersions of such colloids can be conveniently purchased from companies such as the DuPont Company of Wilmington, Delaware. The hydrophilic antireflecting layer 14 layer is most effective when it contains a minimum amount of hydrophobic groups such as methyl or alkyl groups. The hydrophilic antireflecting layer 14 preferably should contain less than 5% hydrocarbon groups by weight. A preferred embodiment of the invention uses aminopropyltriethoxysilane as the crosslinking agent for the hydrophilic antireflecting layer 14, with the addition of colloidal silica to increase the porosity of the layer. The thickness of the hydrophilic antireflecting layer 14 is controlled so that it is an odd integral multiple of an effective quarter wavelength of the exposing laser radiation wavelength. The amount of silica added to the layer may be from 100 to 5000% of the crosslinking agent, and most preferably from 500% to 1500% of the crosslinking agent. Surfactants, dyes, colorants useful in visualizing the written image, addenda to increase the refractive index of the layer, and other addenda may be added to the hydrophilic antireflecting layer 14, as long as their level is low enough that there is no significant interference with the effective quarter wave thickness of the layer or the ability of the layer to hold water and repel ink. Organic polymer hydrophilic antireflecting layer 14 may also be employed in this invention. Gelatin, polyvinylalcohol, co-polyvinylmethylether-maleic anhydride, and polyacrylamide, alone, or in combination with other polymers or with inorganic hydrophilic materials and crosslinking agents may also be employed in this invention.

The radiation or light used to expose, or write, the image on the lithographic printing plate of this invention is conveniently provided by a laser. In a preferred embodiment of the invention, the laser is a diode laser, because of the reliability and low maintenance of diode laser systems. However, other lasers, such as gas or solid state lasers, may also be used.

The layers 12 and 14 are coated on the base 10 by any of the commonly known coating methods such as spin coating, knife coating, gravure coating, dip coating, or extrusion hopper coating. The process for using the resulting lithographic plate comprises the steps of 1) exposing the plate to a focused laser beam in the areas where ink is desired in the printing image, and 2) employing the plate on a printing press. No heating, processing, or cleaning is needed before the printing operation. A vacuum cleaning dust collector may be useful during the laser exposure step to keep the focusing lens clean. Such a collector is fully described in U.S. Pat. No. 5,574,493. The power, intensity and exposure level of the laser is fully described in the above cross referenced copending U.S. patent application Ser. No. 08/979,916 filed Mar. 13, 1997 entitled "Lithographic Printing Plates With a Sol-Gel Layer"; and Ser. No. 08/816,287 filed Mar. 13, 1997 entitled "Method of Imaging Lithographic Printing Plates With High Intensity Laser".

In a preferred embodiment of the invention the hydrophilic antireflecting layer 14 is a layer of colloidal silica crosslinked with about 10% aminopropyltriethoxysilane by weight. Although such as layer is very effective in the offset lithographic printing process in accepting aqueous fountain solution and rejecting lithographic ink, the index of refraction of the layer is too low to permit a wide selection of metals which, when combined with the correct thickness of the hydrophilic antireflecting layer 14 will result in efficient antireflection of light. However, even with such a low refractive index hydrophilic antireflecting layer 14, when tin is used as the metal, the lowering of the reflection with concomitant increase in absorption of light will serve to increase the writing speed of element by a large amount, as the example shown below indicates. In general, choice of a hydrophilic antireflecting layer 14 with a higher index of refraction will allow a wider selection of metals which can be used, and lower levels of reflection.

For a hydrophilic antireflecting layer 14 of certain index of refraction, the thickness of the hydrophilic antireflecting layer 14 and the metal used are selected to have a relectance minimum (min) in accordance with the relationship:

$$\text{Reflectance(min)}=[(r_{(1)}-r_{(2)})^2]/[(1-r_{(1)}r_{(2)})^2]<0.5$$

wherein $$r_{(1)}=(n_{(1)}-n_{(0)})/(n_{(1)}+n_{(0)})$$

$n_{(1)}$ is the index of refraction of the melanophobic antireflecting layer, and $n_{(0)}$ is the index of refraction of the medium adjacent to the antireflecting layer, and $$r_{(2)}=\{[(n_{(m)}-n_{(1)})^2+K_m^2]/(n_{(m)}+n_{(1)})^2+K_m^2]\}^{1/2}$$

wherein n(m) is the index of refraction of the metal light absorbing layer, and

Km is the absorption coefficient of the metal layer.

In practice, when silica is used in antireflecting layer 14, then preferred metals in layer 12 are tin, palladium, or molybdenum. For higher refractive index hydrophilic antireflecting layers 14, titanium, iron, zinc, tungsten, niobium, nickel, cobalt, bismuth and antimony are also preferred metals.

The following example illustrates the invention.

EXAMPLE 1

An thin sputtered layer of tin having an optical density of about 1.5 on a polyethyleneterphthalate base was spin coated at 2000 rpm with a mixture of 7 g of Nalco 2326 (colloidal silica from the Nalco Corporation) with 3 g of water and 10 mg of nonyl phenoxy polyglycidol and 50 mg of 3-aminopropyltriethoxy-silane. When dry, the coating was baked at 100° C. for 3 minutes. The reflection spectrum of the coating was taken and compared to the spectrum of the tin before coating. A second coating was made in the same way and again the reflection spectrum was taken. The procedure was repeated a third time, and the results are tabulated in Table 1.

TABLE 1

| # Silica Layers | 400 nm % Refl. | 600 nm % Refl. | 700 nm % Refl. | 800 nm % Refl. | 900nm % Refl. |
|---|---|---|---|---|---|
| 0 | 70 | 81 | 78 | 76 | 75 |
| 1 | 43 | 72 | 73 | 73 | 73 |
| 2 | 61 | 61 | 61 | 64 | 64 |
| 3 | 66 | 72 | 64 | 58 | 57 |

The results shown in Table 1 show that a single layer of silica coated under the described conditions provides an effective quarter wave (EQW) thickness antireflection wavelength somewhere in the ultraviolet region of the spectrum. A second layer provides an EQW wavelength at about 600 nm, and a third layer provides an EQW at about 900 nm. The improvement in absorption, and therefore in writing speed, is about a factor of 2.

The invention has been described in detail, with particular reference to certain preferred embodiments thereof, but it should be understood that variations and modifications can be effected with the spirit and scope of the invention.

Parts List

10 base
12 metal light absorbing layer
14 hydrophilic antireflecting layer
16 laser beam
20 exposed area

What is claimed is:

1. A direct write lithographic printing plate comprising:

a) a base layer;

b) a metal absorbing layer provided over the base layer and including a metallic element of the Periodic Table of the Elements either alone or in combination with another element or alloyed with another elements selected so as to absorb particular wavelengths of light;

c) an melanophobic antireflecting layer provided over the metal absorbing layer and formed of an hydrophilic material containing a colloid having a thickness equal to an effective quarter wave for a beam of light of a given wavelength which passes through a selected portion of the melanophobic layer and into the metal light absorbing layer and is absorbed by such metal layer to provide a heat source which causes the removal, at the selected portion, of the melanophobic layer, the melanophobic antireflection layer being selected to have a reflectance minimum (min) in accordance with the relationship:

$$\text{Reflectance(min)}=[(r_{(1)}-r_{(2)})^2]/[(1r_{(1)}r_{(2)})^2]<0.5$$

wherein $r_{(1)}=(n_{(1)}-n_{(0)})/(n_{(1)}+n_{(0)})$, $n_{(1)}$ is the index of refraction of the melanophobic antireflecting layer, $n_{(0)}$ is the index of refraction of the medium adjacent to the antireflecting layer, and $$r_{(2)}=\{[(n_{(m)}-n_{(1)})^2+K_m^2]/(n_{(m)}+n_{(1)})_2+K_m^2]\}^{1/2}$$

wherein n(m) is the index of refraction of the metal light absorbing layer, and

Km is the absorption coefficient of the metal light absorbing layer, and d) the metal layer having an index of refraction and the absorption coefficient selected so that the melanophobic layer serves as an anti-reflection layer for the metal light absorbing layer.

2. The direct write lithographic printing plate of claim 1 wherein the metal light absorbing layer is selected from the group consisting of silica, tin, palladium, and molybdenum.

3. The direct write lithographic printing plate of claim 1 wherein the metal layers are selected from the group consisting of titanium, iron, zinc, tungsten, niobium, nickel, cobalt, bismuth, and antimony.

4. The direct write lithographic printing plate of claim 1 wherein the metal light absorbing layer is tin and the melanophobic layer is silica crosslinked with aminopropyltriethoxysilane.

* * * * *

UNITED STATES PATENT AND TRADEMARK OFFICE

CERTIFICATE OF CORRECTION

PATENT NO. : 6,268,113 B1
DATED : July 31, 2001
INVENTOR(S) : Charles D. DeBoer et al.

It is certified that error appears in the above-identified patent and that said Letters Patent is hereby corrected as shown below:

Column 7,
Line 33, "Reflectance(min) = $[(r_{(1)} - r_{(2)})^2] / [(1r_{(1)}\ r_{(2)})^2] < 0.5$" should read -- Reflectance(min) = $[(r_{(1)} - r_{(2)})^2] / [(1-r_{(1)}\ r_{(2)})^2] < 0.5$ --

Column 8,
Line 9, "$r_{(2)} = \{[(n_{(m)} - n_{(1)})^2 + K_m^2] / (n_{(m)} + n_{(1)})_2 + K_m^2]\}^{1/2}$"

should read

-- $r_{(2)} = \{[(n_{(m)} - n_{(1)})^2 + K_m^2] / (n_{(m)} + n_{(1)})^2 + K_m^2]\}^{1/2}$ --

Signed and Sealed this

Twenty-fifth Day of June, 2002

*Attest:*

*Attesting Officer*

JAMES E. ROGAN
*Director of the United States Patent and Trademark Office*